United States Patent [19]

Mader

[11] 3,939,884

[45] Feb. 24, 1976

[54] MULTI-PURPOSE FUNNEL

[76] Inventor: Karl Werner Mader, Obere Reppischstrasse 35, 8953 Dietikon, Zurich, Switzerland

[22] Filed: Aug. 9, 1973

[21] Appl. No.: 387,162

[30] Foreign Application Priority Data

Nov. 3, 1972 Switzerland ..... 016165/72

[52] U.S. Cl. ..... 141/333; 141/367

[51] Int. Cl.[2] ..... B65B 39/00

[58] Field of Search ..... 141/199–205, 141/297–300, 310, 311, 331–345, 367, 379, 392, 383, 384; 285/179, 236

[56] References Cited

UNITED STATES PATENTS

| | | | |
|---|---|---|---|
| 892,000 | 6/1908 | Mackaskie | 141/331 UX |
| 3,516,694 | 6/1970 | Schwartz | 285/236 |

FOREIGN PATENTS OR APPLICATIONS

| | | | |
|---|---|---|---|
| 811,765 | 8/1951 | Germany | 285/236 |
| 121,519 | 2/1948 | Sweden | 141/331 |
| 244,011 | 2/1947 | Switzerland | 141/332 |

*Primary Examiner*—Richard E. Aegerter
*Assistant Examiner*—Frederick R. Schmidt
*Attorney, Agent, or Firm*—Ulle C. Linton

[57] ABSTRACT

A multi-purpose funnel with handle, a flanged rim to prevent overflow and a discharge spout. The funnel comprises two co-axial connections with male thread, the smaller diameter connection having a tubular extension and a rubber seal. Discharge pipes are provided, there pipes can be bushed into the connection spout.

7 Claims, 5 Drawing Figures

MULTI-PURPOSE FUNNEL

The invention relates to a multi-purpose funnel with handle, a flanged rim to prevent overflow, and a discharge spout, e.g. for use in garages, work-shops and petrol filling stations.

Funnels with handle and flanged rim are known with the funnel discharge pipe arranged in the funnel axis or, for filling through less easily accessible openings, with the discharge pipe designed as an elbow piece.

The requirement became evident, however, to have a funnel which can either be attached to, and detached from, the container to be filled or, alternatively, can be fitted with a removable vertical discharge pipe or, alternatively, can be connected to a discharge pipe elbow piece which is adjustable both horizontally and vertically.

This requirement can be met by the multipurpose funnel according to the invention. A characteristic feature of it is that two co-axial connections with male thread are provided, the smaller diameter connection having a tubular extension and a rubber seal, and that discharge pipes can be bushed into the connection spout.

The illustrations show an example of the invention, i.e.

Figure 1:
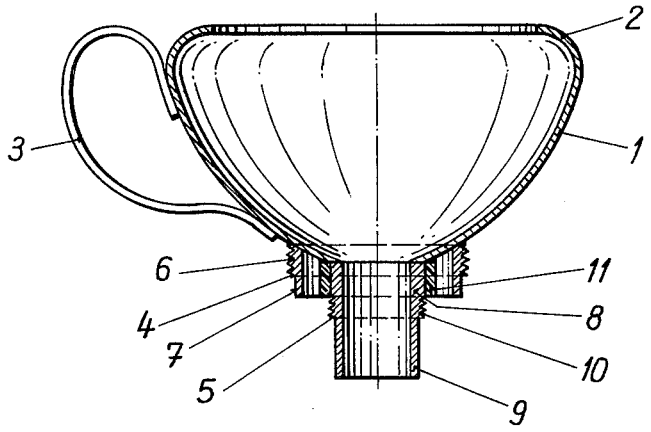
Figure 2:
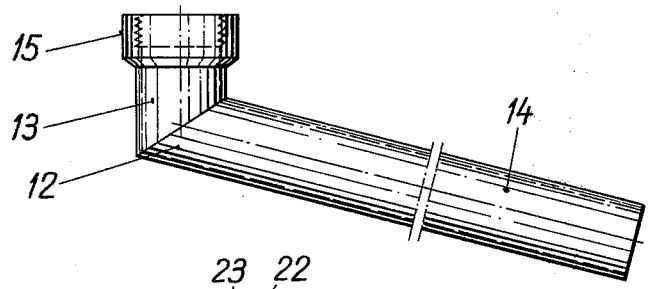
Figure 3:
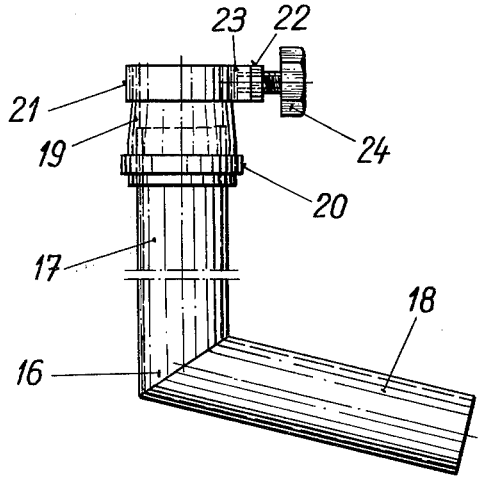
Figure 4:
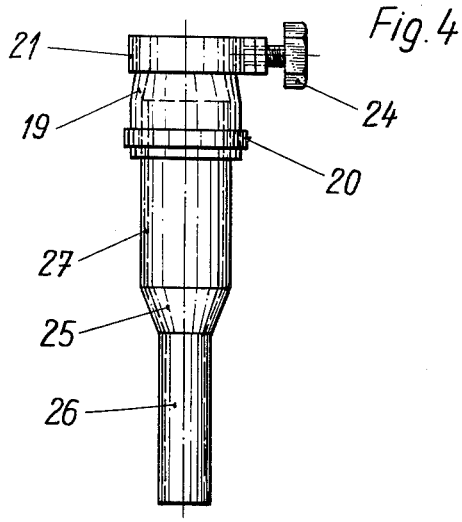
Figure 5:
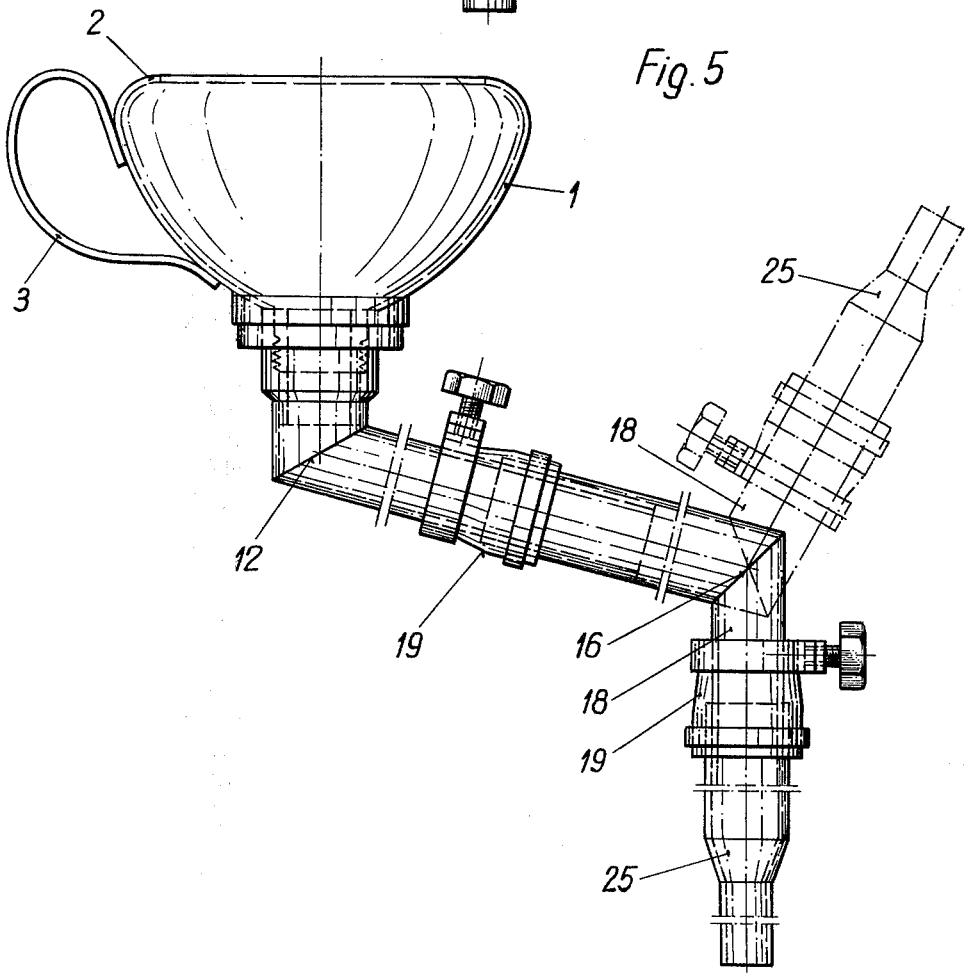

FIG. 1 a vertical section through the funnel with its connections;

FIG. 2 an elbow piece with a threaded union socket end, side elevation;

FIG. 3 an elbow piece with rubber sleeve and adjustment collar, side elevation;

FIG. 4 a cylindrical reduction pipe with rubber sleeve and adjustment collar, side elevation;

FIG. 5 the funnel with telescopically jointed pipe lengths in operating position and, indicated by the dash-dotted lines, with the discharge end piece in drip-proof rest position.

The multi-purpose funnel shown in FIG. 1 comprises a cup or bowl 1 with a flanged rim 2 and a handle 3. At the bottom of bowl 1 are two co-axial connections 4 and 5. The larger connection 4 consists of a cylindrical ring welded to the bowl 1 with a male thread 6 around its upper portion and a collar 7 at its bottom portion. The connection 4 is designed to screw the bowl 1 on to a vessel, e.g. a barrel used for petrol, oil etc. The smaller connection 5 is a discharge pipe length which in its upper portion is designed as a thicker cylindrical collar 8 whilst the thinner lower portion 9 is a plain pipe connection piece. Sleeved over the upper, thicker portion 8 is a flat rubber seal 11 which ocvers the uppermost turn of the thread 10. Discharge pipes 12, 16, 25 are provided which can be jointed to the bowl 1. The elbow piece 12 (FIG. 2) is intended for pouring a liquid through an aperture which would be less accessible in a horizontal direction. This elbow consists of a short, wider portion 13 and a long, narrower portion 14. The centre lines of these two parts 13 and 14 are at an angle of 110° one to another. The short, thicker portion 13 is fitted with a threaded collar 15 so as to enable the elbow 12 to be screwed on to the smaller connection 5 of the bowl 1.

Where the aperture of the vessel to be filled is at a lower lateral position, the elbow 16 can be used (FIG. 3). Same comprises a long, wider portion 17 and a short, narrower portion 18. The centre lines of the two parts 17 and 18 are also angled through 110 degrees relative to each other. At the upper end of the long, wider portion 17 is a rubber sleeve 19 which is locked in place by the clamping collar 20 in such a manner that it projects with half its length beyond the pipe 17. Arranged at the upper end of the rubber sleeve 19 is a locking ring 21 with a female, nut-shaped block 22 and an abutment washer 23. By turning the pinch bolt 24 one can alter the inner diameter of the sleeve 19. It is possible for the pipe 16, by means of the sleeve 19, to be clamped direct to the tubular portion 9 of the smaller funnel end piece 5.

If the aperture through which a liquid has to be fed, is at the top of a vessel which is not accessible from the side, pipe 16 with its long, wider portion 17 and rubber sleeve 19 can be telescoped over the long, narrower portion 14 of the elbow 12 (FIG. 5).

Filling through small openings is by means of a cylindrical reduction pipe 25 with a narrower end piece 26 and a wider portion 27 (FIG. 4). Arranged at the upper end of this wider portion 27 is a projecting rubber sleeve 19 which is locked in place by the clamping collar 20. At the upper end of the rubber sleeve 19 is an adjustable locking device 21, 22, 23 with pinch bolt 24. It is possible for the reduction pipe 25, by means of the rubber sleeve 19, to be clamped direct to the tubular portion 9 of the smaller funnel end piece 5. It can also be attached in a telescopically adjustable manner to pipe 14 of elbow 12 or to pipe 18 of elbow 16.

In FIG. 5 all of the pipes 12, 16 and 25 are joined together with elbow 12 connected to the bowl 1. Funnel discharge pipes 12, 16 and 25 are ajjustable both horizontally and vertically.

To prevent liquid residues from dripping off when the funnel assembly is stored after use, the elbow piece 16 together with the reduction pipe 25 can be turned into the position indicated by the dash-dotted lines.

The multi-purpose funnel described above is designed for use in particular by garages, workshops and filling stations.

I claim:

1. The combination of a multi-purpose funnel and attachment therefor, said funnel comprising a bowl with inwardly flanged open top and a bottom opening, a handle on said bowl, a ring being fixed to said bowl and having a threaded periphery, an outflow tube being fixed to said bowl around said bowl opening and within said ring, said tube having a partially threaded periphery and portion of smaller diameter than said tube threaded periphery, a gasket being mounted on said tube, said attachment comprising a second tube having an internally threaded end portion in threaded engagement with said first mentioned tube threaded periphery, said second tube having said first mentioned tube portion of smaller diameter telescopically extending therein and said second tube having a portion of smaller diameter relative to and extending angularly from said threaded portion of said second tube.

2. The combination of a multipurpose funnel and attachment therefor as claimed in claim 1 wherein said attachment comprises a second tube having a straight portion with a second straight portion of smaller diameter than said first straight portion, a resilient sleeve having said second tube first portion extending in one end thereof and said first tube portion partially extending in the other end thereof, an adjustable collar surrounding said sleeve and said first tube portion connecting the same and a collar surrounding said sleeve and said second tube first portion therein connecting the same.

3. The combination of a multi-purpose funnel and attachment therefor as claim in claim 2 wherein said second tube second portion extends on an angle to said first portion thereof.

4. The combination of a multi-purpose funnel and attachment therefor as claimed in claim 2 wherein said second tube second portion extends in line with said first portion thereof.

5. The combination of a multi-purpose funnel and attachment therefor as claimed in claim 1 including a resilient sleeve having said second tube angular portion partially extending therein, an adjustable collar surrounding and connecting said sleeve and said second tube angular portion therein, a third tube partially extending into said sleeve and a collar retaining said third tube in said sleeve.

6. The combination of a multi-purpose funnel and attachment therefor as claimed in claim 5 wherein said third tube has a straight portion and a portion of relatively smaller diameter than and extending on an angle to said first portion.

7. The combination of a multi-purpose funnel and attachment therefor as claimed in claim 6 including a second resilient sleeve having said third tube angular portion partially extending therein, a second adjustable collar surrounding said second sleeve and said third tube angular portion therein, a fourth tube partially extending in said second sleeve and a collar connecting said fourth tube and said sleeve.

* * * * *